US009525212B2

(12) United States Patent
Peng et al.

(10) Patent No.: US 9,525,212 B2
(45) Date of Patent: Dec. 20, 2016

(54) FEEDING NETWORK, ANTENNA, AND DUAL-POLARIZED ANTENNA ARRAY FEEDING CIRCUIT

(71) Applicant: HUAWEI TECHNOLOGIES CO., LTD., Shenzhen (CN)

(72) Inventors: Hongli Peng, Shanghai (CN); Weihong Xiao, Shenzhen (CN); Linlin Wang, Xi'an (CN); Wei Luo, Xi'an (CN); Ni Ma, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 82 days.

(21) Appl. No.: 14/681,614

(22) Filed: Apr. 8, 2015

(65) Prior Publication Data

US 2015/0214592 A1 Jul. 30, 2015

Related U.S. Application Data

(63) Continuation of application No. PCT/CN2013/084945, filed on Oct. 10, 2013.

(30) Foreign Application Priority Data

Oct. 10, 2012 (CN) ..... 2012 2 0516613 U

(51) Int. Cl.
*H01Q 21/00* (2006.01)
*H01Q 25/00* (2006.01)
(Continued)

(52) U.S. Cl.
CPC ..... *H01Q 21/0075* (2013.01); *H01P 1/165* (2013.01); *H01P 5/12* (2013.01);
(Continued)

(58) Field of Classification Search
None
See application file for complete search history.

(56) References Cited

U.S. PATENT DOCUMENTS 7,042,412 B2 5/2006 Chuang
2004/0252070 A1 12/2004 Chuang
(Continued)

FOREIGN PATENT DOCUMENTS

CN 201163660 12/2008
CN 101615724 12/2009
(Continued)

OTHER PUBLICATIONS

Bin, F., *Impact of small base station antenna*, Shenzhen Chinese Communication Co., Ltd. (10 pp.).
(Continued)

*Primary Examiner* — Robert Karacsony
(74) *Attorney, Agent, or Firm* — Staas & Halsey LLP

(57) ABSTRACT

Embodiments of the present invention disclose a feeding network, and the feeding network includes: a first balun device of a first feeding subnetwork, where the first balun device is connected to a PCB positive 45-degree polarized port, which results in an equal amplitude and a 180-degree phase difference of signals at the first positive 45-degree polarized output port and the second positive 45-degree polarized output port; and a second balun device of a second feeding network, where the second balun device is connected to a PCB negative 45-degree polarized port, which results in an equal amplitude and a 180-degree phase difference of signals at the first negative 45-degree polarized output port and the second negative 45-degree polarized output port. The feeding network in the embodiments has a relatively small size and can cover multiple frequency bands.

16 Claims, 5 Drawing Sheets

(51) Int. Cl.

| | |
|---|---|
| ***H01Q 9/16*** | (2006.01) |
| ***H01Q 21/26*** | (2006.01) |
| ***H01Q 9/04*** | (2006.01) |
| ***H01Q 21/24*** | (2006.01) |
| ***H01Q 21/06*** | (2006.01) |
| ***H01P 1/165*** | (2006.01) |
| ***H01P 5/12*** | (2006.01) |

(52) U.S. Cl.

CPC ..... *H01Q 9/0457* (2013.01); *H01Q 9/16* (2013.01); *H01Q 21/062* (2013.01); *H01Q 21/24* (2013.01); *H01Q 21/26* (2013.01); *H01Q 25/001* (2013.01)

(56) References Cited

U.S. PATENT DOCUMENTS

| | | | |
|---|---|---|---|
| 2008/0111757 | A1 | 5/2008 | Bisiules et al. |
| 2009/0066601 | A1 | 3/2009 | Eom et al. |
| 2011/0175782 | A1 | 7/2011 | Choi et al. |

FOREIGN PATENT DOCUMENTS

| | | | |
|---|---|---|---|
| CN | 102280720 | | 12/2011 |
| CN | 202797284 | | 3/2013 |
| EP | 2346114 | A2 | 7/2011 |
| GB | 2333400 | | 7/1999 |
| JP | 4-120901 | | 4/1992 |
| JP | 2001-44753 | | 2/2001 |
| JP | 2004-172906 | | 6/2004 |
| KR | 10-2007-0020272 | | 2/2007 |
| KR | 10-2008-0071991 | | 8/2008 |
| KR | 10-2010-0080652 | | 7/2010 |
| KR | 10-2012-0078896 | | 7/2012 |
| WO | 2005/122331 | A1 | 12/2005 |
| WO | 2007/060148 | A1 | 5/2007 |
| WO | 2010/033004 | A2 | 3/2010 |

OTHER PUBLICATIONS

Sim, C. et al., *Dual-Feed Dual-Polarized Patch Antenna With Low Cross Polarization and High Isolation*, IEEE Transactions on Antennas and Propagation, vol. 57, No. 10, Oct. 2009, pp. 3405-3409.

International Search Report, dated Jan. 16, 2014, in corresponding International Application No. PCT/CN2013/084945 (11 pp.).

Extended European Search Report, dated Jul. 13, 2015, in corresponding European Application No. 13845753.6 (7 pp.).

Korean Office Action dated May 27, 2016 in corresponding Korean Patent Application No. 10-2015-7010545.

Korean Office Action dated Nov. 24, 2015 in corresponding Korean Patent Application No. 10-2015-7010545.

Japanese Office Action dated Mar. 8, 2016 in corresponding Japanese Patent Application No. 2015-535973.

International Search Report mailed Jan. 16, 2014 in corresponding international application PCT/CN2013/084945.

FEEDING NETWORK, ANTENNA, AND DUAL-POLARIZED ANTENNA ARRAY FEEDING CIRCUIT

CROSS-REFERENCE TO RELATED APPLICATIONS

This application is a continuation of International Application No. PCT/CN2013/084945, filed on Oct. 10, 2013, which claims priority to Chinese Patent Application No. 201220516613.7, filed on Oct. 10, 2012, both of which are hereby incorporated by reference in their entireties.

TECHNICAL FIELD

The present invention relates to the field of wireless communications technologies, and in particular, to a feeding network, an antenna, and a dual-polarized antenna array feeding circuit.

BACKGROUND

Rapid development and application of base station antenna technologies for mobile communications vigorously promotes a development orientation of a miniaturized, integrated, multifunctional (multiband, multipole, and multipurpose) base station antenna. An antenna feeding network is one of important components of a base station antenna subsystem, and its high performance and miniaturization are important factors that restrict further miniaturization of a base station antenna system. Therefore, designing a high-performance miniaturized base station antenna feeding network has become a focus of antenna technology research.

Currently, there are many documents about base station feeding antenna technologies at home and abroad. The article Impact of a Miniaturized Base Station Antenna publicized on the journal Telecommunications Technology on Dec. 25, 2011 is the most representative. The article mainly describes a tri-band base station antenna that may be applied to 806-960 MHz, 1710-2170 MHz, and 1710-2170 MHz, where a size of the antenna is 1340 mm×380 mm×100 mm.

It can be learned that the base station antenna feeding network in the prior art can cover multiple frequency bands, but the size of the base station antenna feeding network is too large to meet a miniaturization requirement of an antenna in a new communications system.

SUMMARY

Embodiments of the present invention provide a feeding network, an antenna, and a dual-polarized antenna array feeding circuit, where the feeding network has a relatively small size and can cover multiple frequency bands.

An embodiment of the present invention provides a feeding network, where the feeding network is disposed on a printed circuit board PCB, where the PCB includes: a positive 45-degree polarized port, a negative 45-degree polarized port, a first positive 45-degree polarized output port, a second positive 45-degree polarized output port, a first negative 45-degree polarized output port, and a second negative 45-degree polarized output port; and the feeding network includes: a first feeding subnetwork and a second feeding subnetwork, where the first feeding subnetwork includes: a first balun device, a first microstrip, and a second microstrip, where an input end of the first balun device is connected to the positive 45-degree polarized port, the first microstrip is connected between a first output end of the first balun device and the first positive 45-degree polarized output port, and the second microstrip is connected between a second output end of the first balun device and the second positive 45-degree polarized output port; and the first microstrip and the second microstrip have an equal electrical length and an equal characteristic impedance value, which results in an equal amplitude and a 180-degree phase difference of signals at the first positive 45-degree polarized output port and the second positive 45-degree polarized output port; and the second feeding subnetwork includes: a second balun device, a third microstrip, and a fourth microstrip, where an input end of the second balun device is connected to the negative 45-degree polarized port, the third microstrip is connected between a first output end of the second balun device and the first negative 45-degree polarized output port, and the fourth microstrip is connected between a second output end of the second balun device and the second negative 45-degree polarized output port; and the third microstrip and the fourth microstrip have an equal electrical length and an equal characteristic impedance value, which results in an equal amplitude and a 180-degree phase difference of signals at the first negative 45-degree polarized output port and the second negative 45-degree polarized output port.

An embodiment of the present invention further provides an electromagnetic dipole antenna, where the electromagnetic dipole antenna includes the feeding network; and the electromagnetic dipole antenna further includes: a first feeder pillar and a second feeder pillar that are diagonally disposed, a third feeder pillar and a fourth feeder pillar that are diagonally disposed, and a horizontal radiating element disposed above the feeder pillars, where the first feeder pillar and the second feeder pillar are respectively configured to connect to a first positive 45-degree polarized output port and a second positive 45-degree polarized output port of the feeding network; and the third feeder pillar and the fourth feeder pillar are respectively configured to connect to a first negative 45-degree polarized output port and a second negative 45-degree polarized output port of the feeding network.

An embodiment of the present invention further provides an antenna, and the antenna includes the feeding network.

An embodiment of the present invention further provides a dual-polarized antenna array feeding circuit, where the circuit includes four feeding networks; and the circuit further includes: a positive 45-degree polarized external power division feeding subnetwork and a negative 45-degree polarized external power division feeding subnetwork, where the positive 45-degree polarized external power division feeding subnetwork has four output ends, and each output end is separately connected to a positive 45-degree polarized port of each feeding network; and the negative 45-degree polarized external power division feeding subnetwork has four output ends, and each output end is separately connected to a negative 45-degree polarized port of each feeding network.

An embodiment of the present invention further provides a dual-polarized antenna array feeding circuit, and the circuit includes n feeding networks, where n is a positive integer.

In the feeding network described in the embodiments of the present invention, a balun device is disposed on each signal input port. An excitation current signal input by the signal input port is divided into two current signals that have an equal amplitude and opposite phases, and the two current signals are respectively transmitted to signal output ports corresponding to the signal input port by using a pair of microstrips having an equal electrical length and an equal characteristic impedance value, which results in an equal amplitude and a 180-degree phase difference of signals at the two signal output ports.

In comparison with the existing feeding network, in the embodiments of the present invention, two balun devices are additionally disposed. Therefore, on a basis of not increasing a size of the feeding network, a coverage range of a frequency band of the feeding network is extended, so that the feeding network has a relatively small size and can cover multiple frequency bands.

BRIEF DESCRIPTION OF DRAWINGS

To describe the technical solutions in the embodiments of the invention more clearly, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the invention with reference to the accompanying drawings in the embodiments of the invention. Apparently, the described embodiments are merely a part rather than all of the embodiments of the invention. All other embodiments obtained by a person of ordinary skill in the art based on the embodiments of the invention without creative efforts shall fall within the protection scope of the invention.

The embodiments of the present invention provide the present invention, which relates to the field of wireless communications technologies, and in particular, to a feeding network, an antenna, and a dual-polarized antenna array feeding circuit, where the feeding network has a relatively small size and can cover multiple frequency bands.

Figure 1:
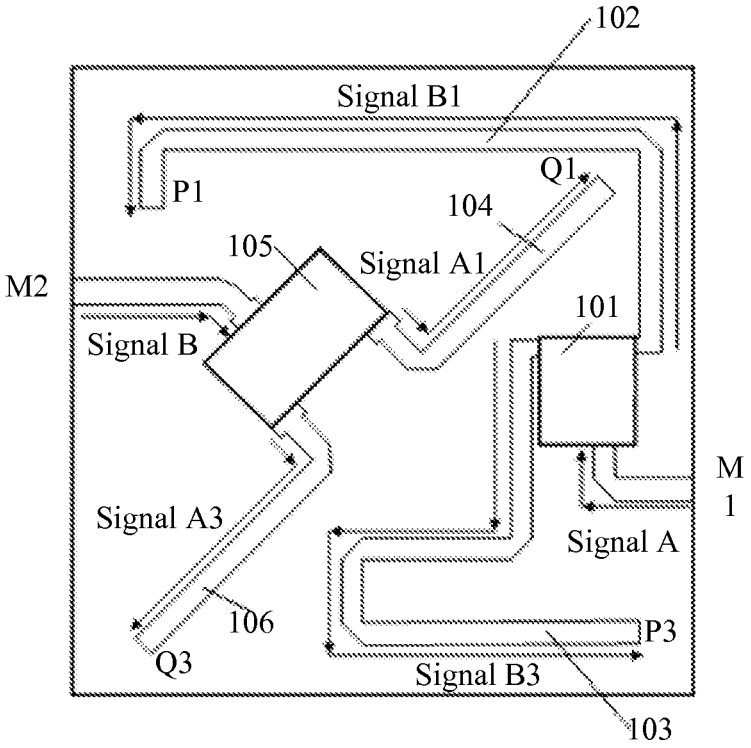
FIG. 1 is a physical structural diagram of a feeding network according to an embodiment of the present invention.

Referring to FIG. 1, FIG. 1 is a physical structural diagram of a feeding network according to an embodiment of the present invention. The feeding network is disposed on a PCB (printed circuit board) 10.

Two signal input ports and four signal output ports are disposed on the PCB 10.

As shown in FIG. 1, the two signal input ports are respectively: a positive 45-degree polarized port M1 and a negative 45-degree polarized port M2.

The four signal output ports are respectively: a first positive 45-degree polarized output port P1 and a second positive 45-degree polarized output port P3 that correspond to the positive 45-degree polarized port M1, and a first negative 45-degree polarized output port Q1 and a second negative 45-degree polarized output port Q3 that correspond to the negative 45-degree polarized port M2.

Specifically, the positive 45-degree polarized port M1 and the negative 45-degree polarized port M2 are respectively disposed on two edges that are on the PCB 10 and opposite to each other. The first positive 45-degree polarized output port P1 and the second positive 45-degree polarized output port P3 are diagonally disposed and form a pair of output ports. The first negative 45-degree polarized output port Q1 and the second negative 45-degree polarized output port Q3 are diagonally disposed and form a pair of output ports.

The positive 45-degree polarized port M1 receives an excitation current, the excitation current is separately transmitted to the first positive 45-degree polarized output port P1 and the second positive 45-degree polarized output port P3 by using a microstrip, and an externally-connected feeder pillar is fed by using the first positive 45-degree polarized output port P1 and the second positive 45-degree polarized output port P3.

The negative 45-degree polarized port M2 receives an excitation current, the excitation current is separately transmitted to the first negative 45-degree polarized output port Q1 and the second negative 45-degree polarized output port Q3 by using a microstrip, and an externally-connected feeder pillar is fed by using the first negative 45-degree polarized output port Q1 and the second negative 45-degree polarized output port Q3.

As shown in FIG. 1, the feeding network includes: a first feeding subnetwork and a second feeding subnetwork.

Figure 2:
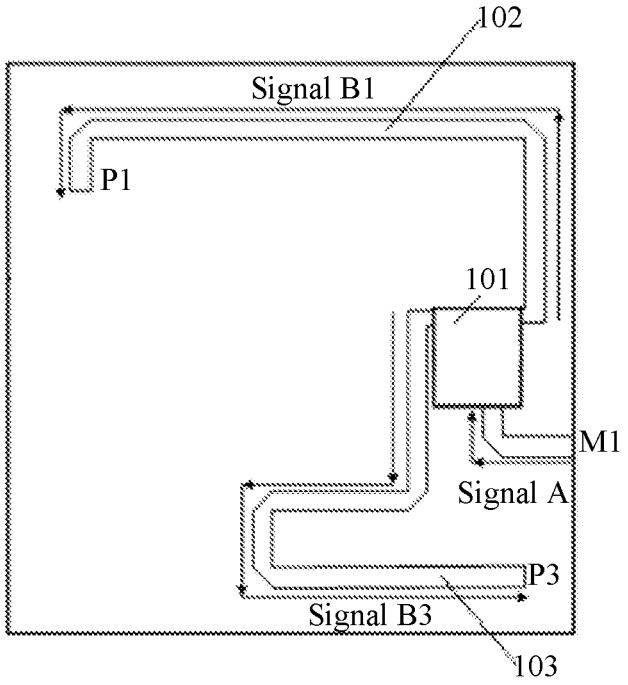
FIG. 2 is a physical structural diagram of a first feeding subnetwork according to an embodiment of the present invention.

FIG. 2 is a physical structural diagram of a first feeding subnetwork according to an embodiment of the present invention. As shown in FIG. 2, the first feeding subnetwork includes: a first balun (balance-unbalance conversion) device 101, a first microstrip 102, and a second microstrip 103.

An input end of the first balun device 101 is connected to the positive 45-degree polarized port M1; the first microstrip 102 is connected between a first output end of the first balun device 101 and the first positive 45-degree polarized output port P1; the second microstrip 103 is connected between a second output end of the first balun device 101 and the second positive 45-degree polarized output port P3.

The first balun device 101 receives an excitation current signal A input by the positive 45-degree polarized port M1, and outputs a first current signal B1 and a second current signal B3 that have an equal amplitude and opposite phases.

The first balun device 101 and the first microstrip 102 as well as the second microstrip 103 are separately in an electrically connected state. The first microstrip 102 transmits the first current signal B1 output from the first balun device 101 to the first positive 45-degree polarized output port P1. The second microstrip 103 transmits the second current signal B3 output from the first balun device 101 to the second positive 45-degree polarized output port P3.

The first microstrip 102 and the second microstrip 103 have an equal electrical length and an equal characteristic impedance value, which results in an equal amplitude and a 180-degree phase difference of signals at the first positive 45-degree polarized output port P1 and the second positive 45-degree polarized output port P3.

Figure 3:
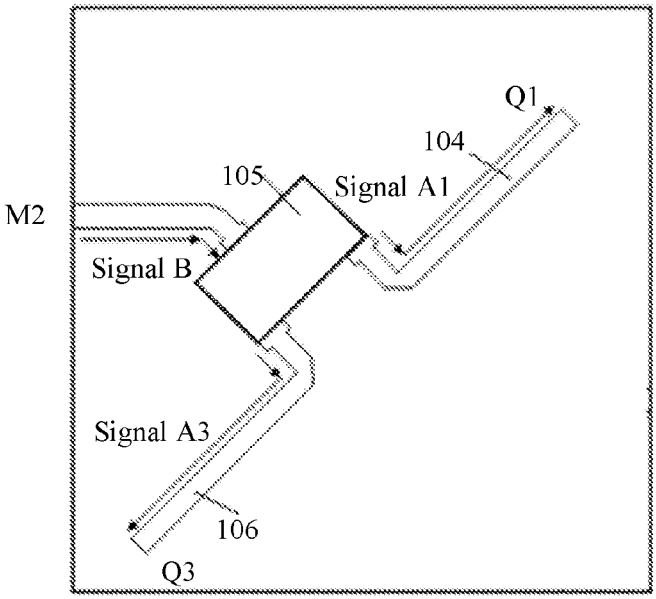
FIG. 3 is a physical structural diagram of a second feeding subnetwork according to an embodiment of the present invention.

FIG. 3 is a physical structural diagram of a second feeding subnetwork according to an embodiment of the present invention. As shown in FIG. 3, the second feeding subnetwork includes: a second balun device 105, a third microstrip 104, and a fourth microstrip 106.

An input end of the second balun device 105 is connected to the negative 45-degree polarized port M2; the third microstrip 104 is connected between a first output end of the second balun device 105 and the first negative 45-degree polarized output port Q1; and the fourth microstrip 106 is connected between a second output end of the second balun device 105 and the second negative 45-degree polarized output port Q3.

The second balun device 105 receives an excitation current signal B input by the negative 45-degree polarized port M2, and outputs a third current signal A1 and a fourth current signal A3 that have an equal amplitude and opposite phases.

The second balun device 105 and the third microstrip 104 as well as the fourth microstrip 106 are separately in an electrically connected state. The third microstrip 104 transmits the third current signal A1 output from the second balun device 105 to the first negative 45-degree polarized output port Q1. The fourth microstrip 106 transmits the fourth current signal A3 output from the second balun device 105 to the second negative 45-degree polarized output port Q3.

The third microstrip 104 and the fourth microstrip 106 have an equal electrical length and an equal characteristic impedance value, which results in an equal amplitude and a 180-degree phase difference of signals at the first negative 45-degree polarized output port Q1 and the second negative 45-degree polarized output port Q3.

In the feeding network described in this embodiment of the present invention, a balun device is disposed on each signal input port. An excitation current signal input by the signal input port is divided into two current signals that have an equal amplitude and opposite phases, and the two current signals are respectively transmitted to signal output ports corresponding to the signal input port by using a pair of microstrips having an equal electrical length and an equal characteristic impedance value, which results in an equal amplitude and a 180-degree phase difference of signals at the two signal output ports.

In comparison with the existing feeding network, in this embodiment of the present invention, two balun devices are additionally disposed. Therefore, on a basis of not increasing a size of the feeding network, a coverage range of a frequency band of the feeding network is extended, so that the feeding network has a relatively small size and can cover multiple frequency bands.

It should be noted that FIG. 1 to FIG. 3 show a preferred design solution of the feeding network provided in this embodiment of the present invention. Certainly, the solution is only a preferred implementation form of the present invention, and in another embodiment of the present invention, an implementation form of the feeding network may be but is not limited to the form shown in FIG. 1.

As shown in FIG. 1, a relative dielectric constant of the PCB 10 Er=2.56, and thickness of the PCB 10 is 0.76 mm.

The first microstrip 102 and the second microstrip 103 of the first feeding subnetwork form a horizontal-vertical microstrip group. Specifically, the first microstrip 102 is in a horizontal state relative to the second microstrip 103, and the second microstrip 103 is in a vertical state relative to the first microstrip 102. In addition, the first microstrip 102 and the second microstrip 103 have an equal electrical length, a characteristic impedance value of 45 ohm, and a corresponding line width of 2.16 mm.

The third microstrip 104 and the fourth microstrip 106 of the second feeding subnetwork form a 45-degree bevel microstrip group. Specifically, both the third microstrip 104 and the fourth microstrip 106 are in a 45-degree diagonal state, and the third microstrip 104 and the fourth microstrip 106 have an equal electrical length, a characteristic impedance value of 45 ohm, and a corresponding line width of 2.16 mm.

The first balun device 101 and the second balun device 105 may be disposed as a planar structure, so as to reduce a size of the feeding network.

The feeding network shown in FIG. 1 has a size of only 60 mm×60 mm×0.76 mm. By using the structure design of the feeding network and two balun devices that are shown in FIG. 1, a coverage frequency band of the feeding network may be 1.71-2.69 GHz. Therefore, a coverage range of a frequency band of the feeding network is extended based on that a size of the feeding network is as small as possible, so that the feeding network has a relatively small size and can cover multiple frequency bands.

Figure 4:
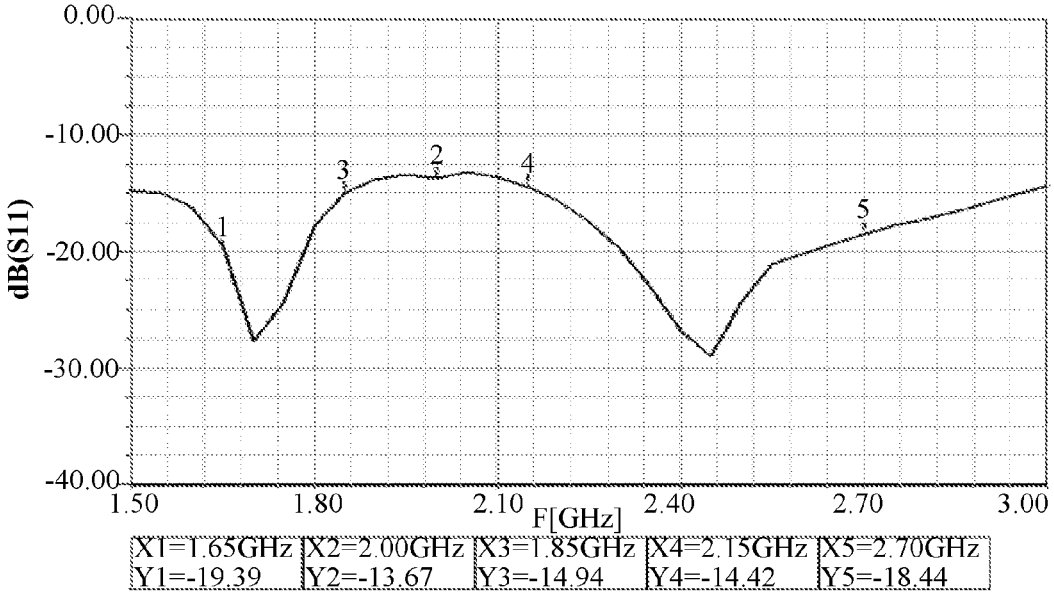
FIG. 4 is a line graph of an S11 parameter of a positive 45-degree polarized port of the feeding network shown in FIG. 1.
Figure 5:
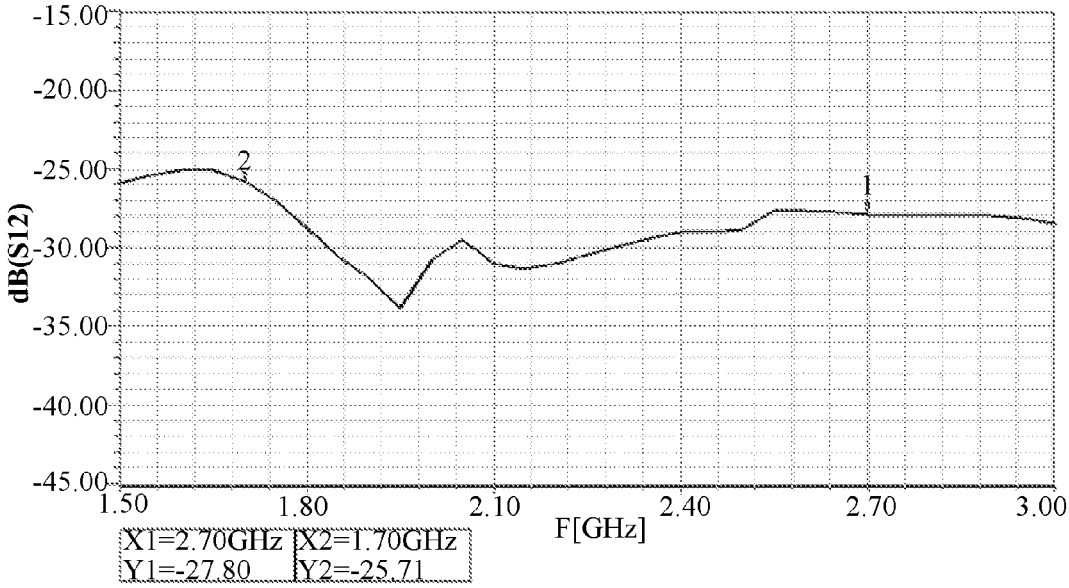
FIG. 5 is a line graph of an S12 parameter of a positive 45-degree polarized port and a negative 45-degree polarized port of the feeding network shown in FIG. 1.

FIG. 4 is a line graph of an S11 parameter of a positive 45-degree polarized port of the feeding network shown in FIG. 1. FIG. 5 is a line graph of an S12 parameter of a positive 45-degree polarized port and a negative 45-degree polarized port of the feeding network shown in FIG. 1. In FIG. 4 and FIG. 5, a horizontal coordinate represents frequency (GHz), and a vertical coordinate represents S parameter (dB).

As shown in FIG. 4, all S11 parameters of the positive 45-degree polarized port of the feeding network in this embodiment of the present invention are less than −14 dB over entire bandwidth; as shown in FIG. 5, all S12 parameters of the positive 45-degree polarized port and the negative 45-degree polarized port of the feeding network are less than −25 dB over entire bandwidth. It is indicated that the feeding network has more than 25 dB polarized isolation over the entire bandwidth, which indicates that the feeding network has good circuit performance.

Figure 6:
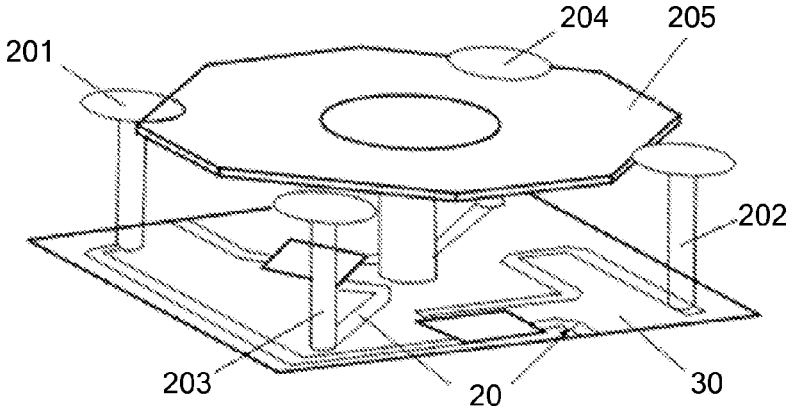
FIG. 6 is a structural diagram of an electromagnetic dipole antenna according to an embodiment of the present invention.

FIG. 6 is a structural diagram of an electromagnetic dipole antenna according to an embodiment of the present invention. As shown in FIG. 6, the electromagnetic dipole antenna includes a feeding network 20 shown in FIG. 1. The feeding network is disposed on a PCB 30.

Four feeder pillars 201 to 204 are disposed on the electromagnetic dipole antenna, and are respectively configured to connect to four signal output ports P1, P3, Q1, and Q3 of the feeding network 20. A horizontal radiating unit 205 is above the four feeder pillars 201 to 204. The feeder pillar is configured to receive an electrical signal output from each signal output port connected to the feeder pillar, radiate an electromagnetic wave outside, and couple a signal to the horizontal radiating unit 205, so as to implement a radiation function of the antenna.

Specifically, the electromagnetic dipole antenna includes: the first feeder pillar 201, the second feeder pillar 202, the third feeder pillar 203, the fourth feeder pillar 204, and the horizontal radiating unit 205.

The first feeder pillar 201 and the second feeder pillar 202 are diagonally disposed; the third feeder pillar 203 and the fourth feeder pillar 204 are diagonally disposed; and the horizontal radiating unit 205 is above the four feeder pillars 201 to 204.

The first feeder pillar 201 and the second feeder pillar 202 are respectively configured to connect to a first positive 45-degree polarized output port P1 and a second positive 45-degree polarized output port P3 of the feeding network 20. The third feeder pillar 203 and the fourth feeder pillar 204 are respectively configured to connect to a first negative 45-degree polarized output port Q1 and a second negative 45-degree polarized output port Q3 of the feeding network 20.

A physical structure and a working principle of the feeding network 20 are the same as the description in the foregoing embodiment, and details are not described herein again.

In the electromagnetic dipole antenna in this embodiment of the present invention, a feeding network described in the embodiment of the present invention is used. A balun device is disposed on each signal input port. An excitation current signal input by the signal input port is divided into two current signals that have equal amplitude and opposite phases, and the two current signals are respectively transmitted by a pair of microstrips having an equal electrical length and an equal characteristic impedance value to signal output ports corresponding to the signal input port, which results in an equal amplitude and a 180-degree phase difference of signals at the two signal output ports.

In this embodiment of the present invention, two balun devices are additionally disposed. Therefore, on a basis of not increasing a size of an electromagnetic dipole antenna, a coverage range of a frequency band of the electromagnetic dipole antenna is extended, so that the electromagnetic dipole antenna has a relatively small size and can cover multiple frequency bands.

The foregoing embodiment of the present invention provides an electromagnetic dipole antenna. In practical application, a feeding network described in the present invention may be but is not limited to being applied to the electromagnetic dipole antenna, and may be applied to an antenna of an existing form, so as to achieve a purpose of extending a coverage range of a frequency band of the antenna on a basis of not enlarging a size of the antenna.

Therefore, this embodiment of the present invention may further include an antenna that includes the feeding network in the foregoing embodiments.

Figure 7:
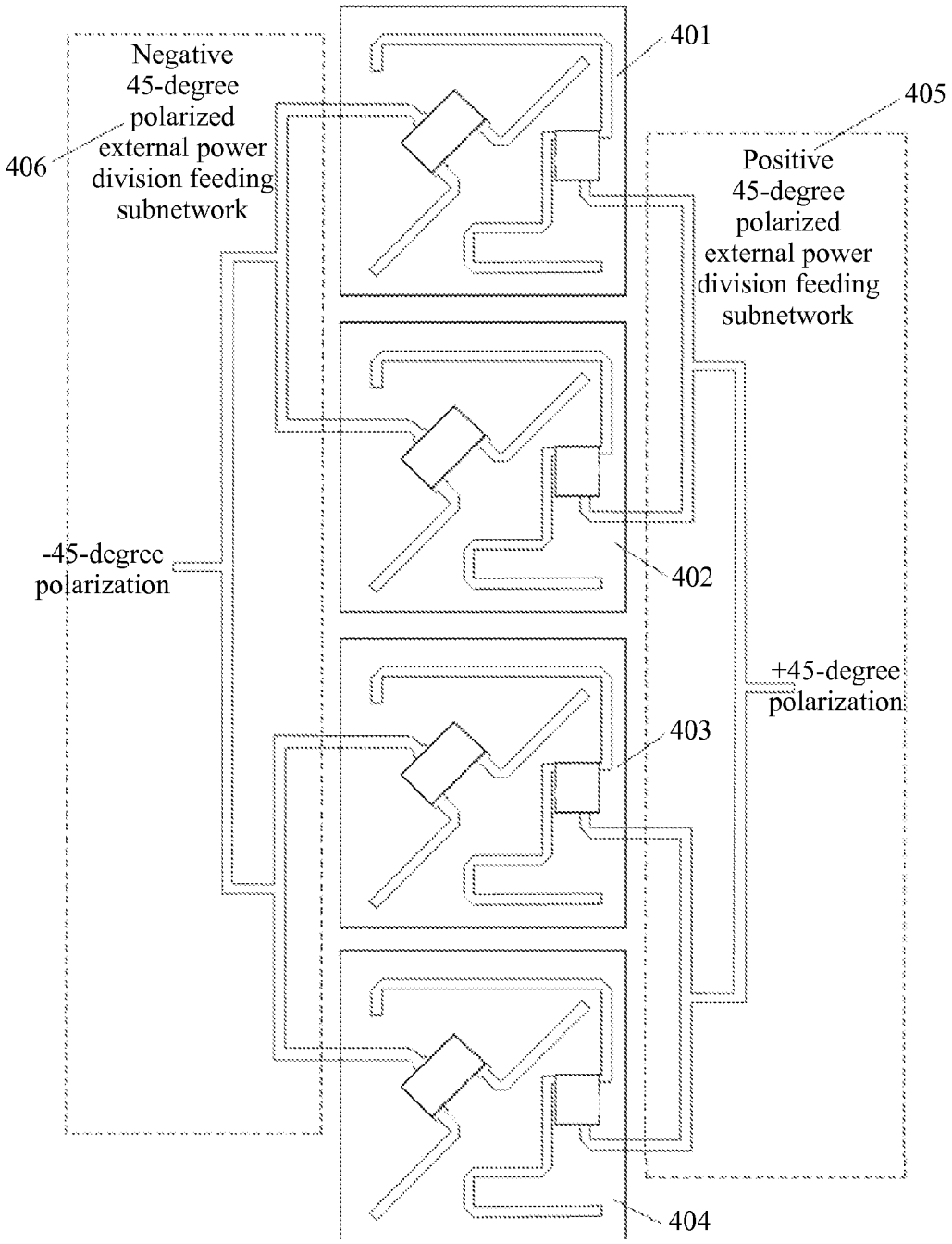
FIG. 7 is a structural diagram of a dual-polarized antenna array feeding circuit according to an embodiment of the present invention.

FIG. 7 is a structural diagram of a dual-polarized antenna array feeding circuit according to an embodiment of the present invention. The dual-polarized antenna array feeding circuit includes four feeding networks 401 to 404 shown in FIG. 1, a positive 45-degree polarized external power division feeding subnetwork 405, and a negative 45-degree polarized external power division feeding subnetwork 406.

As shown in FIG. 7, the positive 45-degree polarized external power division feeding subnetwork 405 has four output ends to accomplish a function of dividing one signal into four signals, where each output end is separately connected to a positive 45-degree polarized port M1 of each feeding network to feed each positive 45-degree polarized antenna, so that the positive 45-degree polarized antenna array collectively accomplishes a function of dividing one signal into eight signals.

The negative 45-degree polarized external power division feeding subnetwork 406 has four output ends to accomplish a function of dividing one signal into four signals, where each output end is separately connected to a negative 45-degree polarized port M2 of each feeding network to feed each negative 45-degree polarized antenna, so that the negative 45-degree polarized antenna array collectively accomplishes a function of dividing one signal into eight signals.

Therefore, the dual-polarized antenna array feeding circuit shown in FIG. 7 forms a two-input sixteen-output feeding network.

In the dual-polarized antenna array feeding circuit described in this embodiment of the present invention, a feeding network described in the embodiment of the present invention is used. A balun device is disposed on each signal input port. An excitation current signal input by the signal input port is divided into two current signals that have an equal amplitude and opposite phases, and the two current signals are respectively transmitted to signal output ports corresponding to the signal input port by using a pair of microstrips having an equal electrical length and an equal characteristic impedance value, which results in an equal amplitude and a 180-degree phase difference of signals at the two signal output ports.

In this embodiment of the present invention, two balun devices are additionally disposed. Therefore, on a basis of not increasing a size of a dual-polarized antenna array, a coverage range of a frequency band of the dual-polarized antenna array is extended, so that the dual-polarized antenna array has a relatively small size and can cover multiple frequency bands.

The foregoing embodiment of the present invention provides a specific implementation form of a dual-polarized antenna array feeding circuit, and the dual-polarized antenna array feeding circuit includes four feeding networks. In practical application, the dual-polarized antenna array feeding circuit described in the present invention may include but is not limited to four feeding networks, and actually, may include a feeding network whose number is any positive integer.

Therefore, this embodiment of the present invention further provides a dual-polarized antenna array feeding circuit, which includes n feeding networks shown in FIG. 1, where n is a positive integer.

The foregoing provides detailed descriptions of the present invention, which relates to the field of wireless communications technologies, and in particular, to a feeding network, an antenna, and a dual-polarized antenna array feeding circuit. Specific examples are used in this specification to describe the principle and implementations of the invention. The foregoing embodiments are merely intended to help understand the method and idea of the invention. In addition, with respect to the implementations and the application scope, modifications may be made by a person of ordinary skill in the art according to the idea of the invention. In conclusion, the content of this specification shall not be construed as a limitation on the present invention.

What is claimed is:

1. A feeding network, wherein the feeding network is disposed on a printed circuit board (PCB), wherein the PCB comprises: a positive 45-degree polarized port, a negative 45-degree polarized port, a first positive 45-degree polarized output port, a second positive 45-degree polarized output port, a first negative 45-degree polarized output port, and a second negative 45-degree polarized output port; and the feeding network comprises: a first feeding subnetwork and a second feeding subnetwork, wherein the first feeding subnetwork comprises: a first balun device, a first microstrip, and a second microstrip, wherein an input end of the first balun device is connected to the positive 45-degree polarized port, the first microstrip is connected between a first output end of the first balun device and the first positive 45-degree polarized output port, and the second microstrip is connected between a second output end of the first balun device and the second positive 45-degree polarized output port; and the first microstrip and the second microstrip have an equal electrical length and an equal characteristic impedance value, which results in an equal amplitude and a 180-degree phase difference of signals at the first positive 45-degree polarized output port and the second positive 45-degree polarized output port; and the second feeding subnetwork comprises: a second balun device, a third microstrip, and a fourth microstrip, wherein an input end of the second balun device is connected to the negative 45-degree polarized port, the third microstrip is connected between a first output end of the second balun device and the first negative 45-degree polarized output port, and the fourth microstrip is connected between a second output end of the second balun device and the second negative 45-degree polarized output port; and the third microstrip and the fourth microstrip have an equal electrical length and an equal characteristic impedance value, which results in an equal amplitude and a 180-degree phase difference of signals at the first negative 45-degree polarized output port and the second negative 45-degree polarized output port.

2. The feeding network according to claim 1, wherein the first microstrip and the second microstrip of the first feeding subnetwork form a horizontal-vertical microstrip group.

3. The feeding network according to claim 2, wherein the first microstrip and the second microstrip have an equal electrical length, a characteristic impedance value of 45 ohm, and a corresponding line width of 2.16 mm.

4. The feeding network according to claim 1, wherein the third microstrip and the fourth microstrip of the second feeding subnetwork form a 45-degree bevel microstrip group.

5. The feeding network according to claim 4, wherein the third microstrip and the fourth microstrip have an equal electrical length, a characteristic impedance value of 45 ohm, and a corresponding line width of 2.16 mm.

6. The feeding network according to claim 1, wherein the first balun device and the second balun device are disposed as a planar structure.

7. An electromagnetic dipole antenna, wherein the electromagnetic dipole antenna comprises a feeding network, a first feeder pillar and a second feeder pillar that are diagonally disposed, a third feeder pillar and a fourth feeder pillar that are diagonally disposed, and a horizontal radiating element disposed above the feeder pillars, wherein the first feeder pillar and the second feeder pillar are respectively configured to connect to a first positive 45-degree polarized output port and a second positive 45-degree polarized output port of the feeding network; and the third feeder pillar and the fourth feeder pillar are respectively configured to connect to a first negative 45-degree polarized output port and a second negative 45-degree polarized output port of the feeding network; and the feeding network is disposed on a printed circuit board (PCB), wherein the PCB comprises: a positive 45-degree polarized port, a negative 45-degree polarized port, a first positive 45-degree polarized output port, a second positive 45-degree polarized output port, a first negative 45-degree polarized output port, and a second negative 45-degree polarized output port; and the feeding network comprises: a first feeding subnetwork and a second feeding subnetwork, wherein the first feeding subnetwork comprises: a first balun device, a first microstrip, and a second microstrip, wherein an input end of the first balun device is connected to the positive 45-degree polarized port, the first microstrip is connected between a first output end of the first balun device and the first positive 45-degree polarized output port, and the second microstrip is connected between a second output end of the first balun device and the second positive 45-degree polarized output port; and the first microstrip and the second microstrip have an equal electrical length and an equal characteristic impedance value, which results in an equal amplitude and a 180-degree phase difference of signals at the first positive 45-degree polarized output port and the second positive 45-degree polarized output port; and the second feeding subnetwork comprises: a second balun device, a third microstrip, and a fourth microstrip, wherein an input end of the second balun device is connected to the negative 45-degree polarized port, the third microstrip is connected between a first output end of the second balun device and the first negative 45-degree polarized output port, and the fourth microstrip is connected between a second output end of the second balun device and the second negative 45-degree polarized output port; and the third microstrip and the fourth microstrip have an equal electrical length and an equal characteristic impedance value, which results in an equal amplitude and a 180-degree phase difference of signals at the first negative 45-degree polarized output port and the second negative 45-degree polarized output port.

8. The electromagnetic dipole antenna according to claim 7, wherein the first microstrip and the second microstrip of the first feeding subnetwork form a horizontal-vertical microstrip group.

9. The electromagnetic dipole antenna according to claim 8, wherein the first microstrip and the second microstrip have an equal electrical length, a characteristic impedance value of 45 ohm, and a corresponding line width of 2.16 mm.

10. The electromagnetic dipole antenna according to claim 7, wherein the third microstrip and the fourth microstrip of the second feeding subnetwork form a 45-degree bevel microstrip group.

11. The electromagnetic dipole antenna according to claim 10, wherein the third microstrip and the fourth microstrip have an equal electrical length, a characteristic impedance value of 45 ohm, and a corresponding line width of 2.16 mm.

12. A dual-polarized antenna array feeding circuit, wherein the circuit comprises four feeding networks, a positive 45-degree polarized external power division feeding subnetwork and a negative 45-degree polarized external power division feeding subnetwork, wherein the positive 45-degree polarized external power division feeding subnetwork has four output ends, and each output end is separately connected to a positive 45-degree polarized port of each feeding network; and the negative 45-degree polarized external power division feeding subnetwork has four output ends, and each output end is separately connected to a negative 45-degree polarized port of each feeding network; and feeding network is disposed on a printed circuit board (PCB), wherein the PCB comprises: a positive 45-degree polarized port, a negative 45-degree polarized port, a first positive 45-degree polarized output port, a second positive 45-degree polarized output port, a first negative 45-degree polarized output port, and a second negative 45-degree polarized output port; and the feeding network comprises: a first feeding subnetwork and a second feeding subnetwork, wherein the first feeding subnetwork comprises: a first balun device, a first microstrip, and a second microstrip, wherein an input end of the first balun device is connected to the positive 45-degree polarized port, the first microstrip is connected between a first output end of the first balun device and the first positive 45-degree polarized output port, and the second microstrip is connected between a second output end of the first balun device and the second positive 45-degree polarized output port; and the first microstrip and the second microstrip have an equal electrical length and an equal characteristic impedance value, which results in an equal amplitude and a 180-degree phase difference of signals at the first positive 45-degree polarized output port and the second positive 45-degree polarized output port; and the second feeding subnetwork comprises: a second balun device, a third microstrip, and a fourth microstrip, wherein an input end of the second balun device is connected to the negative 45-degree polarized port, the third microstrip is connected between a first output end of the second balun device and the first negative 45-degree polarized output port, and the fourth microstrip is connected between a second output end of the second balun device and the second negative 45-degree polarized output port; and the third microstrip and the fourth microstrip have an equal electrical length and an equal characteristic impedance value, which results in an equal amplitude and a 180-degree phase difference of signals at the first negative 45-degree polarized output port and the second negative 45-degree polarized output port.

13. The dual-polarized antenna array feeding circuit according to claim 12, wherein the first microstrip and the second microstrip of the first feeding subnetwork form a horizontal-vertical microstrip group.

14. The dual-polarized antenna array feeding circuit according to claim 13, wherein the first microstrip and the second microstrip have an equal electrical length, a characteristic impedance value of 45 ohm, and a corresponding line width of 2.16 mm.

15. The dual-polarized antenna array feeding circuit according to claim 12, wherein the third microstrip and the fourth microstrip of the second feeding subnetwork form a 45-degree bevel microstrip group.

16. The dual-polarized antenna array feeding circuit according to claim 15, wherein the third microstrip and the fourth microstrip have an equal electrical length, a characteristic impedance value of 45 ohm, and a corresponding line width of 2.16 mm.

* * * * *